US007238117B1

(12) United States Patent
Doss

(10) Patent No.: US 7,238,117 B1
(45) Date of Patent: Jul. 3, 2007

(54) SWING GUIDE FOR GOLFER

(76) Inventor: Jack Doss, 145 Ponderosa Dr., Santa Cruz, CA (US) 95060

( * ) Notice: Subject to any disclaimer, the term of this patent is extended or adjusted under 35 U.S.C. 154(b) by 290 days.

(21) Appl. No.: 11/124,322

(22) Filed: May 4, 2005

Related U.S. Application Data

(63) Continuation-in-part of application No. 10/931,158, filed on Aug. 30, 2004.

(51) Int. Cl.
*A63B 69/36* (2006.01)

(52) U.S. Cl. ..... 473/266; 473/271

(58) Field of Classification Search ..... 473/270, 473/266, 269, 271–273, 257, 219, 278, 279; 273/407; D19/81–85; 211/69.1, 69.5, 69.6; 401/221
See application file for complete search history.

(56) References Cited

U.S. PATENT DOCUMENTS 1,892,509 A * 12/1932 Guyot ..... 211/69.7
1,935,011 A * 11/1933 Bowen ..... 211/69.7
2,011,040 A * 8/1935 Cuthbert ..... 211/69.7
2,110,007 A * 3/1938 Tefft ..... 211/69.7
3,679,206 A * 7/1972 Shambaugh ..... 473/257
4,941,576 A * 7/1990 Sugarman et al. ..... 211/69.1
5,591,090 A * 1/1997 Kauffman, Jr. ..... 473/271
5,616,085 A * 4/1997 LaCoste et al. ..... 473/267
5,707,165 A * 1/1998 Albright ..... 401/221
5,997,410 A * 12/1999 Nothdurft ..... 473/270
6,024,656 A * 2/2000 Lane ..... 473/409
6,346,050 B1 * 2/2002 Larson ..... 473/270

OTHER PUBLICATIONS

Fat Pen [online]. PromoCentral.com [retrieved on Mar. 31, 2005]. copyright Mar. 2001. Retrieved from the Internet:<http://stop.store.yahoo.com/jeffrasof/mw057.html>.*

* cited by examiner

*Primary Examiner*—Raleigh W. Chiu
(74) *Attorney, Agent, or Firm*—Robert Samuel Smith

(57) ABSTRACT

A swing guide exerciser for training a golfer which comprises:
a panel, substantially rectangular, an elongated bar, a coupler secured to the surface of the panel, adjacent a corner, for mounting an end of the bar on the surface wherein the bar forms an acute angle with the short dimension and is perpendicular to said long dimension. Various exercises performed include an exercise to increase back extension and develop increased velocity of the club head.

10 Claims, 6 Drawing Sheets

FIG 8A,
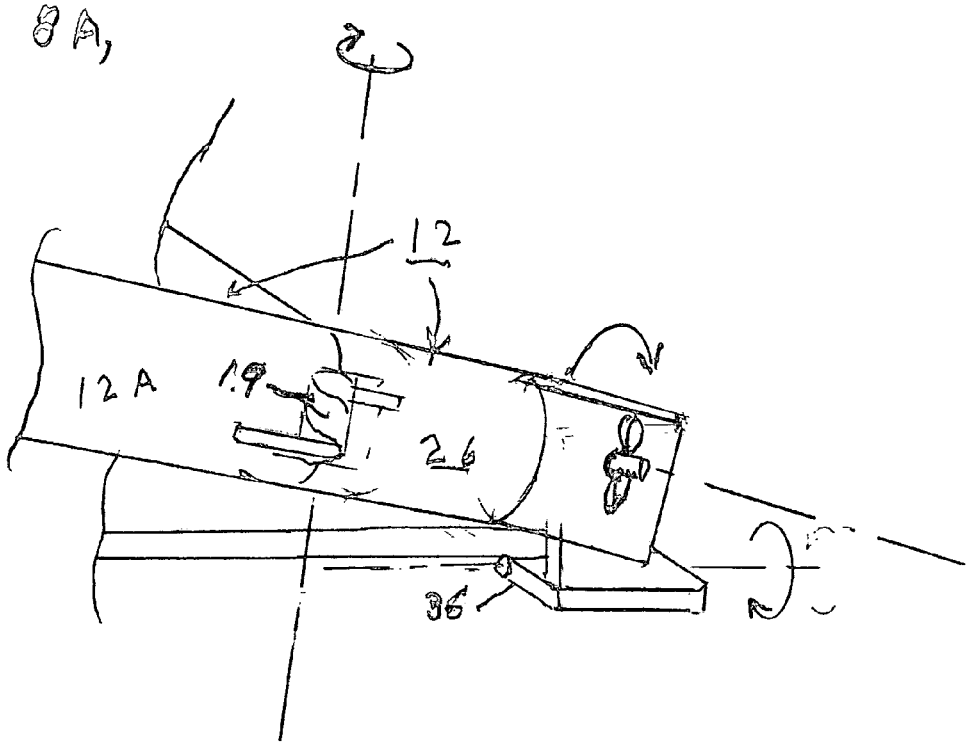
FIG 8B
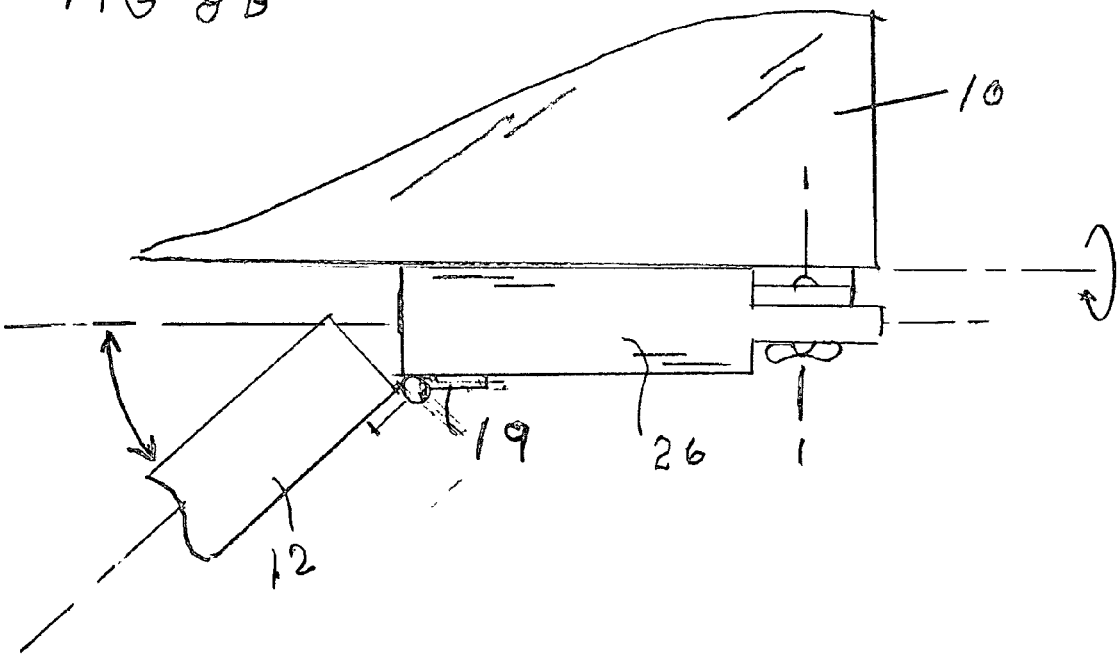

SWING GUIDE FOR GOLFER

CROSS REFERENCE TO EARLIER FILED APPLICATIONS

This application is a continuation-in-part of earlier filed application Ser. No. 10/931,158 filed Aug. 30, 2004 from which priority is claimed.

FIELD OF THE INVENTION

This invention relates to training methods and apparatus for improving the ability to play the game of golf and particularly to a fixture whose use teaches the golfer to position his legs, hips and arms to obtain the most accuracy and power in driving the golf ball.

BACKGROUND AND INFORMATION DISCLOSURE

Driving a golf ball with power and accuracy has been the subject of intense study for more than a century. The objective is simple to define—drive the ball a great distance at a distant target: the green. The coordinated interaction of the legs, trunk and arms to maximize this objective is very complicated.

Devices and training methods have been disclosed that are directed toward this objective. For example a breakaway golf club is described in U.S. Pat. No. 5,195,745, U.S. Pat. No. 5,338,035, U.S. Pat. No. 5,370,396, and U.S. Pat. No. 5,454,568. A common feature of these patents is that, when the golfer swings the club incorrectly, the lower section of the golf shaft swings out of alignment with the upper section. However training with these devices does not teach the golfer the specific mistakes in his swing that are limiting his performance.

To understand the principles of body mechanics involved in maximizing the delivery of power and accuracy to a golf swing, it is useful to consider the mechanics of snapping a bull whip. The bull whip resembles an elongated array of levers (i.e., segments of the whip) beginning with a first lever being the wrist holding the handle of the whip. When the wrist is rotated initially to generate momentum in each whip segment, the segment closest to the wrist is the first to rotate to a horizontal orientation followed by the second segment and remaining segments rotating to the horizontal orientation in order. Each segment transfers its momentum as angular momentum to the next segment with the result that the last segment rotates so fast that it generates a vacuum in the air. The collapsing vacuum is the loud "crack" that is heard when the user "cracks" the whip.

Like any physical activity involving throwing, batting or stroking, the golfer's body performs like a system of connected levers—hips, shoulders, elbows, wrists connected to the end lever—the golf club.

There can be a number of reasons why the golfer does not "swing properly" thereby limiting his driving power and accuracy. These reasons include:

restricting the extent of the back swing;

meeting the ball at a point in the swing where the head of the club has not reached or has surpassed full angular momentum;

shifting one or both legs so as to reduce power of the swing.

In view of the complexity of the problem, it is useful to introduce into the training regimen, exercises to guide the athlete to move all parts of his body in the most efficient manner. This object includes a signal of the exact mistake made in executing the swing.

SUMMARY OF THE INVENTION

It is an object of this invention to provide a device and method of use with which a golfer will improve the distance and accuracy of his drive.

It is a further object that practicing each one of the exercises that the golfer performs with this device will help the golfer to analyze and correct certain movements and/or positions of his body in order to improve his swing.

The apparatus of this invention is directed to a device comprising a rectangular panel about twenty inches by ten inches and a plastic tube, about one inch diameter and about twenty inches long. One end of the tube is secured obliquely adjacent one corner of the panel and on the surface of the panel. The tube is oriented perpendicular to the long edge of the panel and forms an oblique angle of 60 degrees with the short edge of the panel.

In another version of the apparatus, the end of the tube has a swivel connection to the board such that the oblique angle is selectable. After the user adjusts the tube at the oblique angle, the user tightens the swivel connection to secure the tube.

The swivel connection is hingeably mounted on the board so that the tube can be completely swung out of the golfer's way if desired.

The golfer positions himself and the apparatus in five positions to perform exercises designed to improve his swing.

These exercises are directed toward performing a correct back swing, performing a correct down swing, perform a correct follow through

BRIEF DESCRIPTION OF THE DRAWINGS

FIGS 8A,B show another bar constructed as sections mounted end to end on the panel.

DESCRIPTION OF BEST MODE

Figure 1:
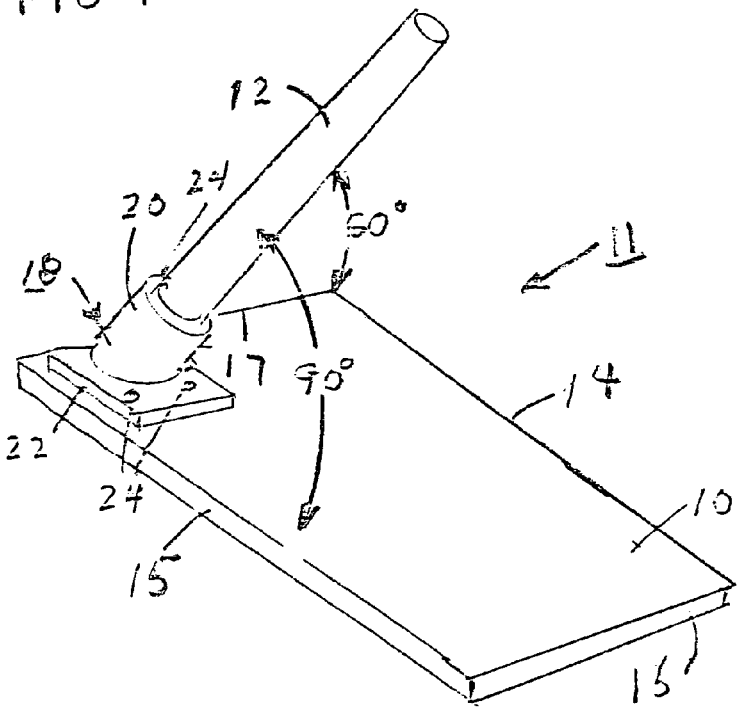
FIG. 1 shows the swing guide exerciser of this invention.

Turning now to a discussion of the drawings. FIG. 1 is a perspective view of the "swing guide" device for practicing the exercises of this invention. There is shown a rectangular panel 10, about 10 inches by 20 inches. A bar 12, about one inch diameter and about eighteen inches long has extends obliquely from a corner of the surface of the panel 10. The bar 12 is perpendicular to the long front edge 15 of the panel and is oriented about 60 degrees from the short rear edge 16 of the panel.

In the following description, the panel 10 is described as having the long rear edge 14, the long front edge 15, the short front edge 16 and the short rear edge 17.

The panel 10 is preferably a polycarbonate sheet, about three eighth inches thick.

The bar 12 is preferably a plastic tube of urethane or similar material.

A coupling 18, for mounting an end of the bar 12 on the panel 10 comprises a short tube 20 mounted on a small panel 22 and secured by bolts 24 through matching openings in one corner of the surface of panel 10 and through the small panel 22. The end of the tube 12 (bar) is inserted into the open end 24 of the coupling 18.

The coupling 18 is bolted to one side of the small panel 22 to enable right handed golfer's to perform exercises described below and on an opposite side of the panel 10 to enable left handed users to practice the exercises. The following exercises are described for a golfer understood to be right handed. However, it will be understood that, if the golfer is left-handed, then he simply mounts the coupler 18 on the reverse side of the panel 10 using the same bolt holes 24.

Figure 2:
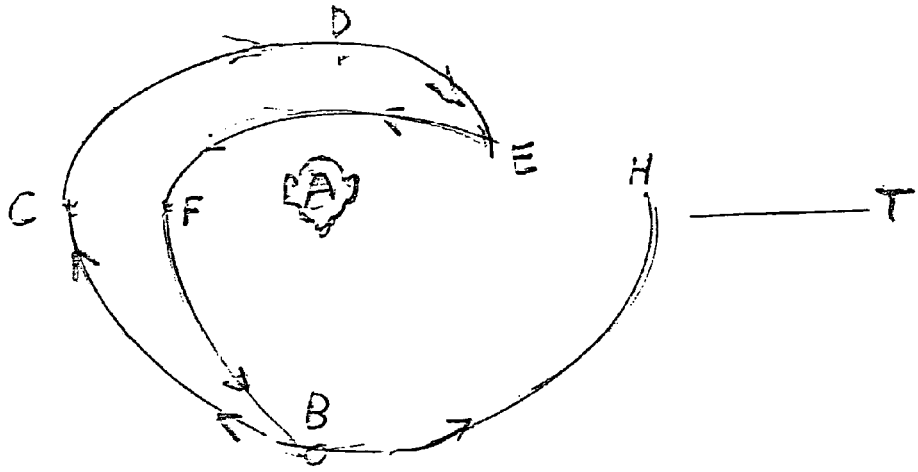
FIG. 2 shows the arc of the club head of a complete swing.

FIG. 2 is a top view of a trace of the club head (looking down at the ground from above the head A of the golfer) where the golfer is performing a "perfect" swing. The direction of travel is indicated by the arrows.

A indicates the head of the golfer, addressing the ball on the tee at location B. Arc B C D E indicates the arc that the club head follows during the back swing.

D is the location of the club head directly in back of the golfer's head, A. Location C is the most rearward extension of the club head away from the target T. E represents the finish point of the backward swing where the travel of the club head reverses direction. F is the position of the club head midway through the downward swing, Note that the club head follows an elliptical path on the forward swing EFBH and that FB is the perigee section of the forward swing where the club head picks up momentum from the uncocking elbows and wrists, The object of the first part of the first exercise is to maximize the distance AC (i.e., a wide backswing). The wide backward sweep on the back swing promotes a late cocking of two levers (wrist and right elbow). These levers are cocked as the club head moves from D to E.

The wrist and right elbow should remain cocked at least ninety degrees during most of the down swing (EFB). They are "uncocked" (released) only by the golfer changing the pulling direction as the club head moves from F to B Uncocking the wrists and elbows increases the kinetic energy delivered to the club and should occur late in the downswing in order to transfer the maximum angular momentum stored in the club head to momentum delivered to the ball.

Swing Guide Position 1—

Figure 3A:
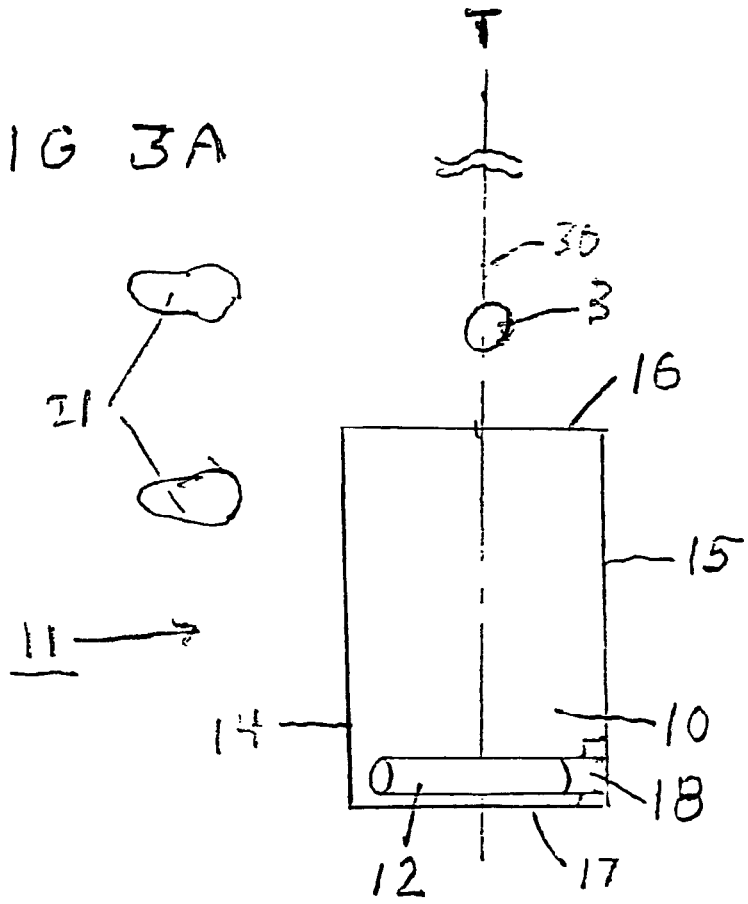
FIG. 3A shows the foot position for executing exercise in FIG. 3B.

FIGS. 3A, B illustrate the top and side views, respectively, of the position of the golfer's feet 21 and the swing guide 11 to perform the first exercise for a right handed golfer.

The panel 10 is flat on the ground with the long front edge 15, parallel to the target line 30. The ball 32 is on the ground at location B (the impact point), six to eight inches from the short front edge 16 of the panel 10. (Short front edge 16 is the closest edge to the target T.

Figure 3B:
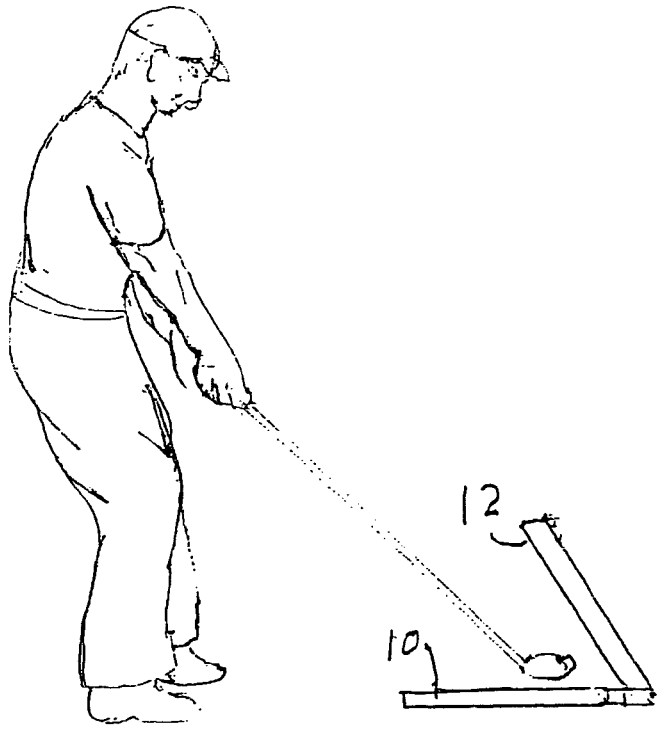
FIG. 3B shows the exercise for training for a proper back swing.

The golfer stands erect with his feet 21 at a location where, his extended arms holding the club, can position the club head to "meet" the ball as shown in FIG. 3B.

To perform "practice swings", the ball is removed. A coin (or tee), placed on the impact point, enables the golfer to keep that point in mind. It is the point slightly before which, the club contacts the ground in the down swing.

The golfer is now ready to take a practice swing.

The golfer places the club head on the panel 10 near the forward edge and slowly swings the club rearward. (away from the target) to begin the back swing (from B to C in FIG. 2.) When the golfer performs the back swing, the club head should gently scrape the panel 10 and miss the tube 12. The slight scraping sound on the backswing signals to the golfer that he is maintaining the head of the club close to the ground on the backswing.

The down swing (immediately following the backswing) is the second part of this movement. The object is to deliver a descending blow from the face of the club head to the ball or, in the case of a practice swing, to the impact point.

When the golfer performs the forward swing (from G to B in FIG. 2) the golfer pulls the club toward himself by forcing his elbows in so that the club head misses both the tube 12 and the panel 10 as shown if FIG. 3B and passes between the tube 12 and the golfer 36.

Preferably, the club head touches ground AFTER the head passes the impact point. Ideally, the square face of the club is descending when the face of the club head meets the ball. This is the lowest point in the arc.

Figure 5B:
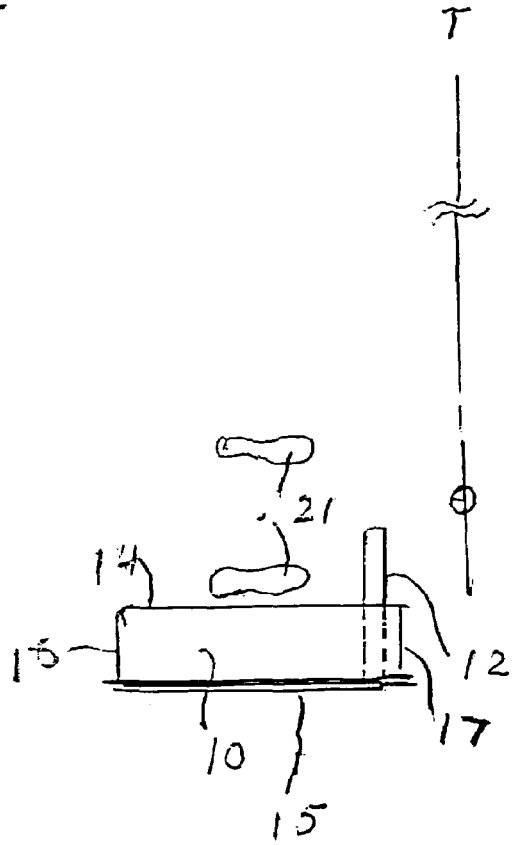
FIG. 5B shows the foot position for the exercise of FIG. 5A.
Figure 5A:
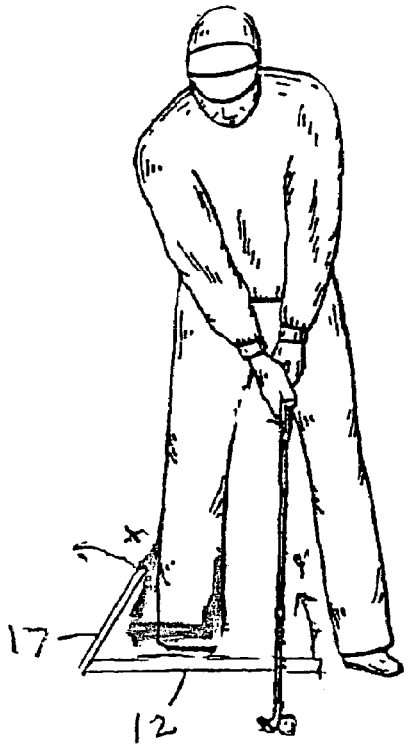
FIG. 5A shows an exercise for correcting the faulty back swing of FIG. 4.

Swing Guide Position 2—(FIGS. 5A,B)

Figure 4:
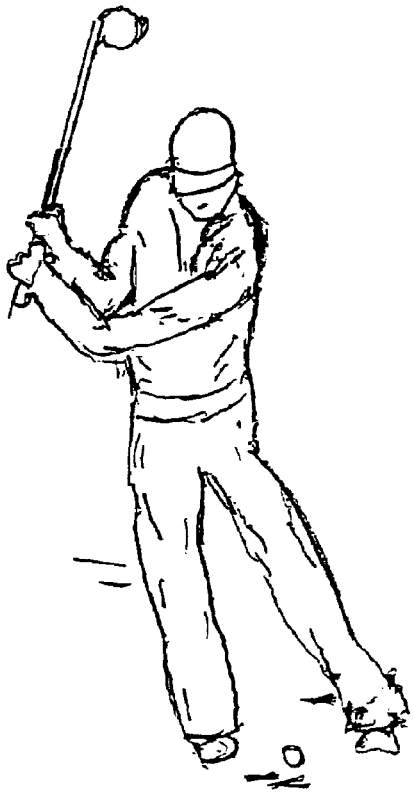
FIG. 4 shows a faulty back swing.

The wide back swing (away from the target) should not be accompanied by the trunk or legs leaning away from the target. Leaning away from the target is illustrated in FIG. 4, which shows the golfers body and leg leaning in the direction of the back swing, away from the target T.

FIG. 5A is an elevation view showing the golfer performing an exercise intended to train the golfer away from this habit. In FIG. 5A, the tube 12 is on the ground and only the short rear edge 17 of the panel 10 (oblique to the tube 12) is shown. The front long edge 14 is distance X from the golfer's leg. FIG. 5B is a plan view showing the position of the golfer's feet 21 relative to the tube 12 and panel 10. The bar 12 is horizontal (on the ground) parallel to the target direction and about two inches in front of the golfer's feet 21. The golfer stands between the target T and panel 10 which is oriented obliquely toward the golfer's calf. The upper (horizontal) rear long edge 14 of the panel 10 is at a midcalf height, and slightly touching the golfer's leg. (X in FIG. 5A).

The golfer addresses the ball and performs the exercise—address the ball, backswing, down swing and forward swing.

If he performs the exercise correctly, his leg will not tilt the rear long edge 14 of panel 10 when the golf performs the back swing so that the bar 12 remains stationary on the ground. If the exercise is not performed correctly, the leg moves against the panel during the back swing causing the bar to rotate away from the ground (arrow Y).

Figure 6B:
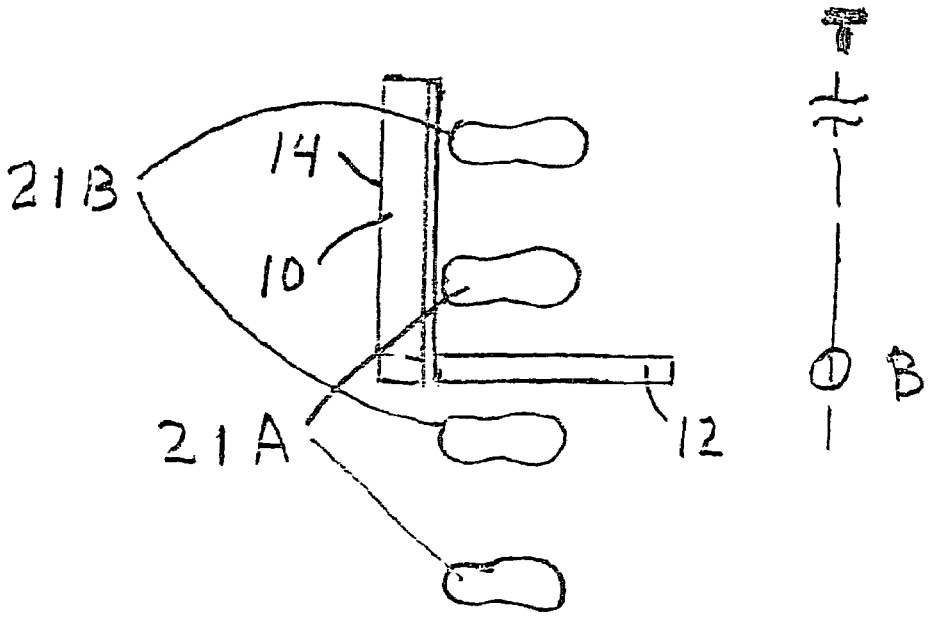
FIG. 6B shows the foot position for the exercise of FIG. 6A.
Figure 6A:
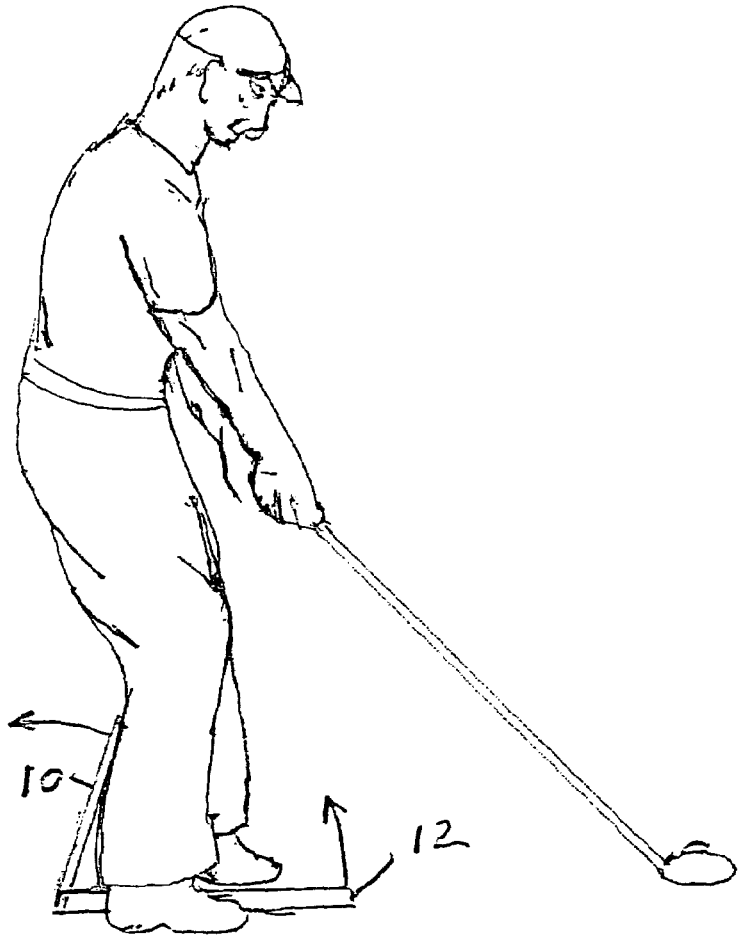
FIG. 6A shows the exercise to train for a correct forward swing.

Swing Guide Position 3.—(FIGS. 6A,B)

Before the golfer swings, his feet should be correctly aligned with the target. When the golfer finishes the forward part of the swing (BJ of FIG. 2,) the golfer should lean away from the impact point B and the target line 30 and toward the target. An exercise for taking the correct stance (the first part) and for developing this movement (the second part) is illustrated in FIGS. 6A and 6B.

The Swing Guide is positioned with the tube 12 lying horizontally and perpendicular to the target centerline 30. The end of the tube 12 points toward the ball. The panel 10 is parallel to the target line FIG. 6B shows the foot position 21A for performing the first part of the exercise. This is a "static" part of the exercise to align the feet correctly. Without moving the swing guide, the golfer places his feet with the tube between his feet. The tube is closest to the foot nearest the target. The panel 10 is located behind the golfer's heels. The elevated rear long edge 14 of the panel 10 is touching slightly the back of the mid calf.

To perform the second part of the exercise (the dynamic part), the golfer moves his feet to position 21B. The tube is close to his foot that is farthest from the target.

The golfer performs his swing. If he performs the forward swing (BH, FIG. 2) of his swing correctly, he be pulling inward toward the target such that his leg (closest to the target) presses against the elevated long rear edge 14 of the panel 12. This rotates the tube 12 upward in the direction Z indicating that he has performed the forward part (BG) of his swing correctly.

There has been described a swing training device whose use evokes a response to a given golf swing that accurately evaluates the swing. In following the training method of this invention, the golfer will experience the feeling of a proper swing path, a kinesthetic message that is essential to learning and remembering a physical activity.

Variations and modifications of the apparatus and method for practicing this invention may be contemplated that are within the scope of the invention.

Figure 7:
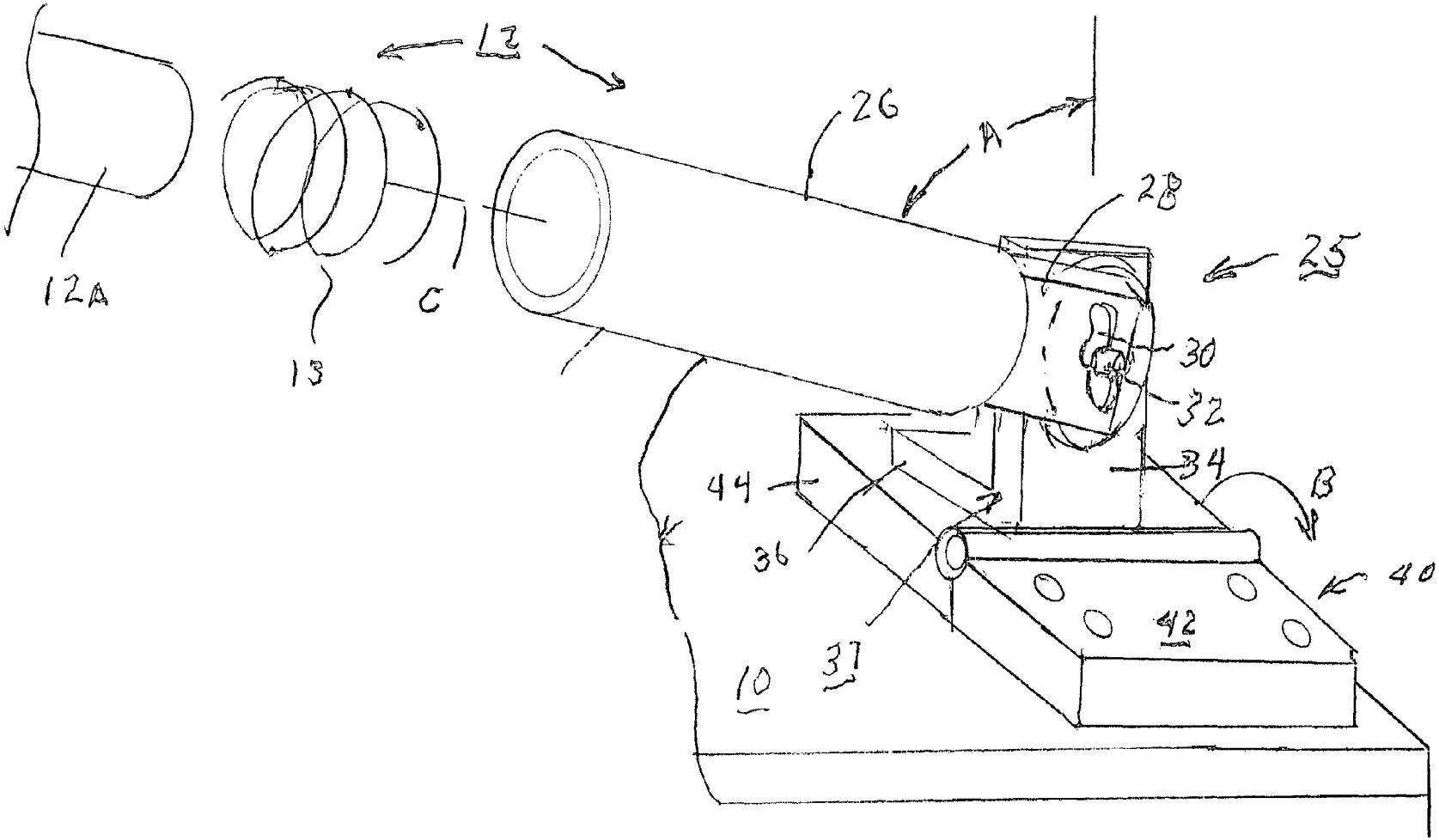
FIG. 7 shows a hinged mounting of the bar to the panel.

For example, FIG. 7 shows another version of the invention in which an end of the bar 12 is connected to the panel 10 by a swivel 35.

The bar 12 comprises two sections, 12A and cylinder 26.

One end of cylinder 26 has one end coupled by a spring 13 to one end of the section 12A of bar 12. The section 12 A is preferably a semi-rigid foam tube so that the bar 12 "gives" when it is inadvertently struck by the golfer practicing the exercises.

A flange 28 extends from the other end of the cylinder 26 parallel to the centerline C of the cylinder 26. The flange 28 is rotatably mounted by a wing nut 30 and screw pin 32 flush against one leg 34 of a hinge-bracket 40. (FIGS. 7, 8A,B show hinge-bracket 40 to comprise an angle bracket 34, 36 mounted on a leaf 44 of hinge 37.

The other leg 36 of the bracket is mounted on one leaf 42 of a hinge whose other leaf 44 is mounted on the top surface of the panel 10 in FIG. 7 and on the bottom surface of the panel 10 in FIG. 8.

The screw pin 32 is parallel to the long dimension of panel 10 and perpendicular to the bar 12.

The angle A which the cylinder 26 makes with the panel 10 is fixed by tightening wing nut 30 on screw pin 32.

Bar 12 can be rotated flat against panel 10 for conveniently carrying the device when so desired.

FIG. 8B, shows the bar section 12A attached to cylinder 26 by a spring loaded hinge 19 so that the bar 12 "gives" when inadvertently struck by the user during exercise.

In use, the golfer orients the bar 12 (sets angle A) as he requires and then secures the bar-panel orientation A (FIG. 7) by tightening the wing nut 30 on the threaded pin 34 through platelet 28.

A useful range of the angle between the bar 12 and short edge of the panel is between 45 and 75 degrees.

In general, the size of the panel 10 is selectable from a range between 12 and 30 inches in the long dimension and from a range between 6 and 16 inches in the short dimension. The length of the tube is selectable from a range of lengths between 14 and 28 inches. The practical thickness of the panel is selectable from a range of thicknesses between ⅛ inch and ¾ inch.

The material of the panel is selectable from a range of materials preferably polycarbonate but alternatively any one of a group of materials that includes PVC, polyethylene, acetate, acrylic, wood, metal. The material of the bar is selectable from a group of plastics that include polyvinyl chloride, polyvinyl acetate, polyethylene, ABS.

The bar is preferably a plastic tube having a resiliency such that the tube is straight when in use as the training aid but has sufficient "give" to avoid injury to a user who accidentally comes into excessive force against the tube.

In the context of this specification a bar is understood to be an elongated member, solid or tubular, round or square.

The diameter of the bar (tube) is selectable from a range of diameters between ½ to two inches.

In view of these various embodiments, I therefore wish to define the scope of my invention by the appended claims.

What is claimed is:

1. A swing guide exerciser (11) on which a golfer stands and performs training exercises, which comprises:

a panel, substantially rectangular and having a surface with a long dimension and a short dimension said dimensions selected to enable a golfer to stand on said panel and perform golf training exercises;

an elongated bar;

a bracket secured to said panel in a corner of said panel a threaded pin extending perpendicularly through an end of said bar and extending through said bracket;

said threaded pin parallel to said long dimension of said panel;

a nut threaded onto said threaded pin providing that orientation of said bar is selectable and secured by tightening said nut on said threaded pin whereby said bracket oriented to where said bar forms an acute angle with said short dimension and is perpendicular to said long dimension said bracket: being a hinge having one leaf secured to said panel;

said hinge having a hinge pin parallel to said short dimension of said panel said pin extending through another leaf of said hinge.

2. The exerciser of claim 1 wherein:

said bar comprises two sections;

means for coupling said sections together with one section having one end coupled to an end of said other section.

3. The exerciser of claim 2 wherein said means for coupling comprises a helical spring having one end telescoping onto an end of one section and another end telescoping onto an end of said other section.

4. The swing guide of claim 1 wherein said bar is resilient.

5. The swing guide exerciser of claim 1 wherein:

said long dimension is selected from a range of dimensions between 12 and 28 inches and said short dimension is selected from a range of dimensions between 6 and 16 inches; and said bar has a length selected from a range of lengths between 14 and 28 inches.

6. The swing guide exerciser (11) of claim 1 wherein said bar (12) is a round tube.

7. The swing guide exerciser (11) of claim 1 wherein said bar is semi rigid foam.

8. The device of claim 1 wherein said bar is a material selected from a list of materials including polyvinyl chloride, polyvinyl, polyethylene, ABS, polycarbonate.

9. The device of claim 1 wherein said panel is a material selected from a list of materials including polycarbonate, PVC, PE.

10. The device of claim 1 wherein said panel has a long dimension of about 20 inches, a short dimension of about 10 inches and said bar is a tube having a length of about 18 inches and a diameter of about 1 inch and said bar having an end mounted on said panel by said coupler forms an angle with said long dimension of about 60 degrees means for coupling said plate to said panel.

* * * * *